United States Patent [19]

Santagati

[11] Patent Number: 4,783,950

[45] Date of Patent: Nov. 15, 1988

[54] MACHINE FOR AUTOMATIC PROTECTIVE WRAPPING FOR USE WITH DIFFERENT-SIZED BAGGAGE

[75] Inventor: Umberto Santagati, Catania, Italy

[73] Assignee: Baggage Pack Italia S.p.A., Catania CA, Italy

[21] Appl. No.: 35,582

[22] PCT Filed: Jun. 12, 1986

[86] PCT No.: PCT/IT86/00042

§ 371 Date: Mar. 9, 1987

§ 102(e) Date: Mar. 9, 1987

[87] PCT Pub. No.: WO87/00144

PCT Pub. Date: Jan. 15, 1987

[30] Foreign Application Priority Data

Jul. 9, 1985 [IT] Italy ..... 48327 A/85

[51] Int. Cl.[4] ..... B65B 11/08; B65B 51/14; B65B 53/06; B65B 59/02

[52] U.S. Cl. ..... 53/463; 53/466; 53/66; 53/75; 53/76; 53/228; 53/557

[58] Field of Search ..... 53/220, 228, 557, 66, 53/75, 76, 373, 450, 466, 463

[56] References Cited

U.S. PATENT DOCUMENTS

| | | | |
|---|---|---|---|
| 2,227,398 | 12/1940 | Mohl | 53/66 |
| 3,490,194 | 1/1970 | Monaghan | 53/75 X |
| 3,503,175 | 3/1970 | Marasso et al. | 53/75 X |
| 3,513,622 | 5/1970 | Timmerbeil | 53/76 X |
| 3,552,088 | 6/1971 | Niwa | 53/66 X |
| 3,589,100 | 6/1971 | Konars et al. | 53/76 X |
| 3,881,089 | 4/1975 | Harkness et al. | 53/76 X |
| 4,217,744 | 8/1980 | Mizutani | 53/66 X |
| 4,537,016 | 8/1985 | Shanklin et al. . | |

FOREIGN PATENT DOCUMENTS

| | | |
|---|---|---|
| 2008421 | 9/1971 | Fed. Rep. of Germany . |
| 3205606 | 8/1983 | Fed. Rep. of Germany . |
| 1456961 | 9/1966 | France . |
| 2138381 | 10/1984 | United Kingdom . |

*Primary Examiner*—Horace M. Culver
*Attorney, Agent, or Firm*—Browdy & Neimark

[57] ABSTRACT

A machine for the automatic protective wrapping of baggage items having different dimensions comprising conveyor belts for moving successive single baggage to an automatic bundling machine with two sealing bars disposed at right angles to each other, to adapt every individual baggage item in a heat-shrinkable plastic film in such a way to form a wrapper sealed on three sides, the fourth being contact-sealed after passage of the wrapper containing the baggage item through a tunnel-type hot-air oven in which the heat-shrinkage of the plastic film takes place with perfect adherence of it to the baggage.

10 Claims, 3 Drawing Sheets

MACHINE FOR AUTOMATIC PROTECTIVE WRAPPING FOR USE WITH DIFFERENT-SIZED BAGGAGE

TECHNICAL FIELD

This invention relates to a machine capable of automatically forming a wrapping of heat-shrinkable plastic protective film over objects having different sizes, in particular when said objects are containers such as luggage, packages, bags, etc. used as baggage. In the passenger transport field, be it by air, rail, road or sea, the passenger is obligated many times to consign his baggage to the carrier who later returns it to the passenger at the destination.

With regard to the air transport of passengers, in particular, the safety of the baggage is not at present assured in any way as far as tampering and damage is concerned.

The baggage may consist of luggage or similar of a certain quality or, in the contrary case, it can be a package or sack which may be of poor quality and may or may not be properly closed. In both cases it would be useful if the baggage were consigned and protected by means of a sealed protective lining.

The following advantages would be derived thereby:

a tight seal making tampering by unauthorized persons impossible, particularly with respect to suitcases closed by means of zippers;

safety against accidental opening through breakage of hinges or latches, during various stages of transport;

protection against damage caused by scratching and cuts to the lining material during all transport stages, especially air transport;

impermeability to condensates and liquids, as well as protection of baggage during loading and unloading operations outdoors, under adverse weather conditions such as rain or snow.

BACKGROUND ART

Wrapping machines using the heat-shrinkable film technique already exist, but have the drawback that they are able only to wrap a series of objects that all have the same dimensions.

DISCLOSURE OF THE INVENTION

Therefore, it is an object of this invention to provide a machine for the automatic protective wrapping, using heat-shrinkable plastic film, of objects fed to it in succession.

A more particular object of this invention is, by means of an automatic system, to obtain the protective wrapping of suitcases, handbags, sacks, packages and similar, of varying dimensions, by means of heat-shrinkable plastic film.

According to the invention, the machine is for the automatic protection of pieces of baggage having differing dimensions which includes, combination:

first conveyor means for moving forward, in succession, single pieces of baggage of different dimensions from the point of departure;

automatic bundling machine fed with the foregoing pieces of baggage coming from said first conveyor means, in a given direction of travel, and having a working surface with an input side;

second conveyor means associated to said working surface for said pieces of baggage;

tunnel-type oven equipped with a third conveyor means onto which said objects are transferred from the second conveyor means;

reception means, for said baggage pieces enclosed in said shrunk plastic film after having passed through said tunnel- type oven, situated at output side of said third conveyor means.

The bundling machine comprises: a sealing unit having a first transverse sealing bar and a respective counterbar situated on the input side of said working surface perpendicular to the direction of travel of said baggage and by a second, longitudinal sealing bar seat at right angles to the first, and a respective sealing counterbar situated on said working surface parallel to the direction of travel of said baggage; stand supporting a lower roll and an upper roll of heat-shrinkable plastic film, said film having a free end; a sheet consisting of said two films sealed at their free ends and positioned vertically through the slot between said first sealing bar and the input side of said working surface; first optic sensors for the detection of the longitudinal dimensions of the individual pieces of baggage for controlling the operation of said first sealing bar to carry out the seal at the rear of said wrapper, followed by the separation of the wrapper from the two free ends of said film and the simultaneous sealing of said ends, one to the other; second optic sensors to detect the transversal dimensions of the single pieces of baggage for controlling the operation of said second sealing bar on the longitudinal side of said wrapper, the closing of the other longitudinal side of said wrapper being effected by contact sealing after shrinking of said plastic film in said tunnel-type oven, while the closing of the front is determined by the continuity of said sheet formed by the two plastic films on the input side of said working surface.

BRIEF DESCRIPTION OF THE DRAWINGS

This invention will be better illustrated hereinafter by the examples of its embodiments shown in the attached drawings, in which.

BEST MODE FOR CARRYING OUT THE INVENTION

Figure 1:
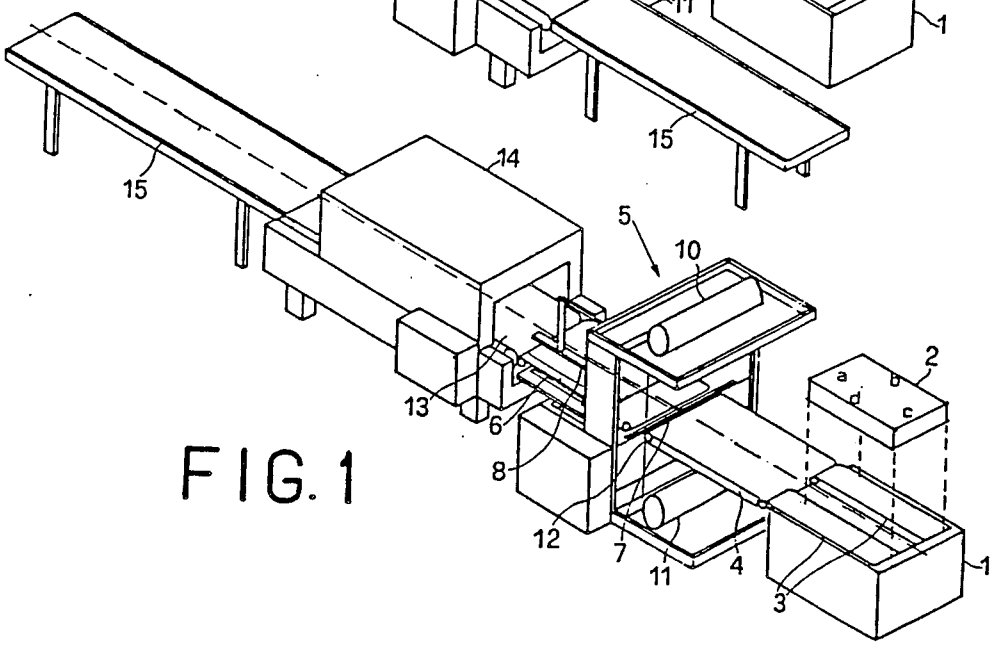
FIG. 1 is a schematic view in perspective of said machine's first embodiment.

Referring to FIG. 1, the number 1 is used to indicate a platform for initial positioning of any object 2 to be covered with a protective wrapper such as, for example, a container rectangular in shape having ends a and 'c' and sides 'b' and 'd' opposite each other. Present at the top of platform 1 are two parallel conveyor belts 3 actuated by either manual or automatic switching, for forward movement of object 2 to a second conveyor belt 4 serving to carry object 2 to an automatic bundling machine, indicated generically by number 5. Bundling machines consists of a working surface constituted by a third conveyor belt 6, a sealing unit constituted by a first transverse sealing bar 7 perpendicular to the direction of travel of the object, and mobile in vertical direction, and a second sealing bar 8 lying parallel to the object's direction of travel and mobile in horizontal and vertical directions. A framework stand 9 supports two rolls, 10 and 11, upper and lower respectively, consisting of reels, of heat-shrinkable plastic film whose free ends are uninterruptedly being sealed one to the other, as will be stated in greater detail below, so as constantly to form continuous sheet 12 extending vertically at the entry of the working surface 6 between its input end and first sealing bar 7.

Fourth conveyor belt 13 carries object 2, wrapped by bundling machine 5 into a wrapper of said heat-shrinkable plastic film closed on three sides in the manner that will be described in detail in the continuation hereof, through tunnel-type hot-air oven 14 where the heat-shrinkage of said plastic film takes place along with the sealing of the fourth side, as will be seen later.

At the output side of oven 14, object 2, in its completed protective wrapper, is placed on idler-roller rack 15 to be picked up.

Figure 2:
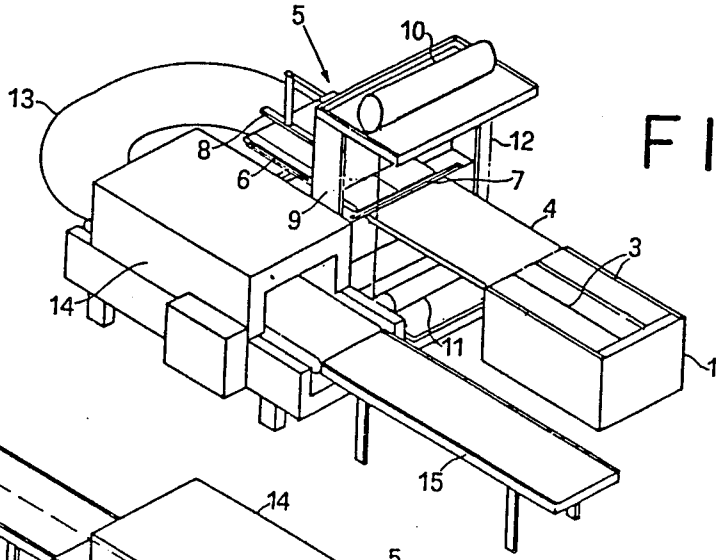
FIG. 2 is a view similar to FIG. 1 of an alternative embodiment of said machine; and, FIGS. 3 (*a*) and (*b*) are a side view and plan respectively which show the positions of the optical sensors for controlling the sealing bars present in said machine.

Shown schematically in FIG. 2 is an alternative embodiment of the machine to which this invention refers, similar in every way to the first except only that conveyor belt 13 to tunnel-type oven 14, rather than being straight, describes a 180° curve to reduce the length of said machine in order to allow it to be installed in rooms adapted to such alternative arrangement.

For purposes of achieving the automatic wrapping of objects of different dimensions being fed successively to the machine in question, several optical sensors are provided, suitably positioned, to 'read' the dimensions of the object to be wrapped and to transmit the data obtained in this way by means of electrical impulses to said sealing unit forming part of bundling machine 5 for its proper operation.

Figure 3:
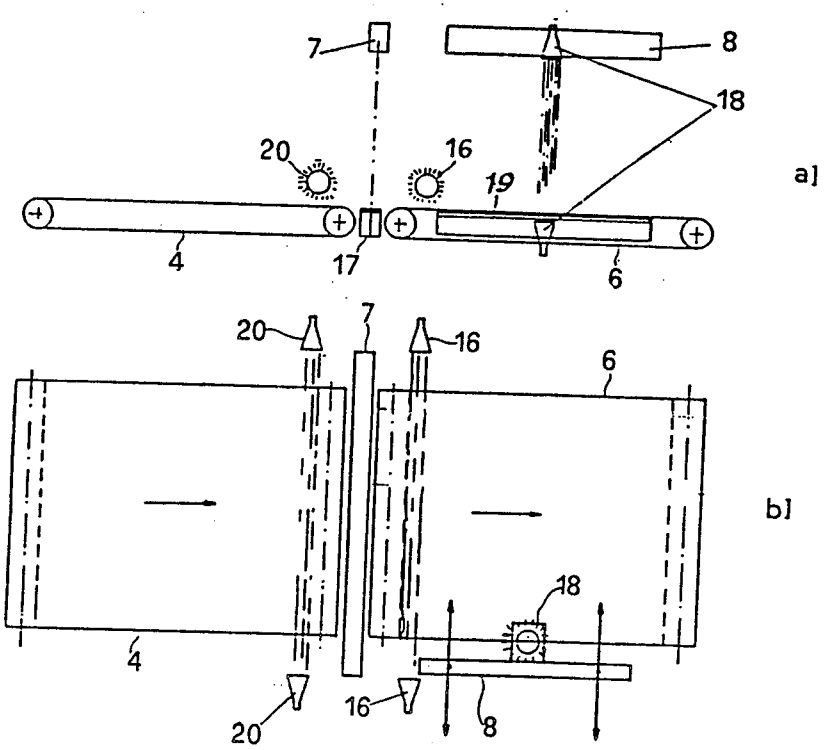

With reference to FIG. 3 in particular, a first pair of optical sensors 16 is arranged at a level higher than working surface 6, perpendicular to the direction of travel of the object, beyond first transverse sealing bar 7 and relative counterbar 17 for the same's operation in accordance with the longitudinal dimensions (sides 'b' and d) of object 2, after which object 2 has proceeded beyond said sealing bar 7.

A second pair of optical sensors 18 is held one by longitudinal second sealing bar 8 and the other by relative counterbar 19. Bar 8 and counterbar 19 move in parallel to each other in transverse direction to working surface 6. Optical sensors 18 actuate sealing bar 8 in accordance with the end dimensions (sides a and c) of object 2, but only after the actuation of first sealing bar 7 has taken place.

A third pair of safety optical sensors 20 placed just ahead of transverse first sealing bar 7, at the same level as first pair of optical sensors 16, does not allow any movement of conveyor belt 4, on which the object to be wrapped is positioned in case of failure to dispose of a previous object due to improper operation of bundling machine 5.

During operation, an object, such as the one indicated by 2 in FIG. 1, is placed on starting platform 1 by means of conveyor belts 3, started up by either manual or automatic switch, and then transferred to conveyor belt 4 which will carry it forward to bundling machine 5. When the front of object 2 comes into contact with continuous sheet 12 formed by the two heat-shrinkable plastic films as stated earlier, along the two free ends, object 2, in its movement as impressed by conveyor belt 2 to conveyor belt 6, and then on the latter, will pull said sheet along with it thereby causing plastic film to unwind from reels 10 and 11. When the rear 'c' of object 2 has passed the alignment of first optical sensors 16, the latter will actuate transversal sealing bar 7 which will move from its raised position (see FIG. 3*a*) as far as contact with counterbar 17 to effect the rear seal (side 'c' of object 2) of the wrapper enveloping object 2. Simultaneously, the action of bar 7 and of counterbar 17 will cut or separate said wrapper from the film unwound from reels 10 and 11 and will seal the free ends together to reconstitute uninterrupted sheet 12. First pair of sensors 16 is sufficiently distant from transverse sealing bar 7 to allow the wrapping of a suitable overabundant quantity of said sheet 12 both to obtain the overlap of said rear seal and for resealing the plastic film's two loose ends so as again to obtain the continuity of sheet 12 for the wrapping of the next object.

Upon the completion of the phase just described, longitudinal sealing bar 8 and relative counterbar 19 move horizontally across working surface 6 in perpendicular direction to the movement of object 2 to check its transverse (sides 'a' and 'c') dimensions by means of optical sensors 18, which will then actuate sealing bar 8 which will bring itself into contact with counterbar 19 to carry out the overlap seal of one side (side 'd' of object 2) of said wrapper. The wrapper around object 2 will, at this point, have been sealed on three sides inasmuch as the front part will have been closed automatically by the continuity of said sheet 12 of plastic film. Also in the second phase as described above, sufficient surplus sheet 12 will have been provided to allow the perfect longitudinal sealing with overlap and the simultaneous cutting of the excess sheet 12, which excess is then discarded.

Object 2, contained in said wrapper of plastic film sealed on three sides ('a', 'c' and 'd') is then moved forward by conveyor belt 13 to tunnel-type hot-air oven 14 in which heat-shrinkage of the plastic film takes place; i.e. its contraction with consequent acquisition of tension in perfect adherence to object 2, now wrapped, and the simultaneous sealing by contact of the fourth side of said wrapper (side 'b' of object 2); i.e. the long side opposite that sealed by second sealing bar 8.

At the outlet of oven 14, object 2, completely enclosed in said protective plastic film, which adheres perfectly to object 2, is placed on idler-roller rack 15 for pickup. Should bundling machine 5 fail to function properly, with the consequent failure to pass an object forward, safety optical sensors 20 prevent movement of conveyor belt 4 to prevent the next object to be wrapped from being moved.

Figure 4:
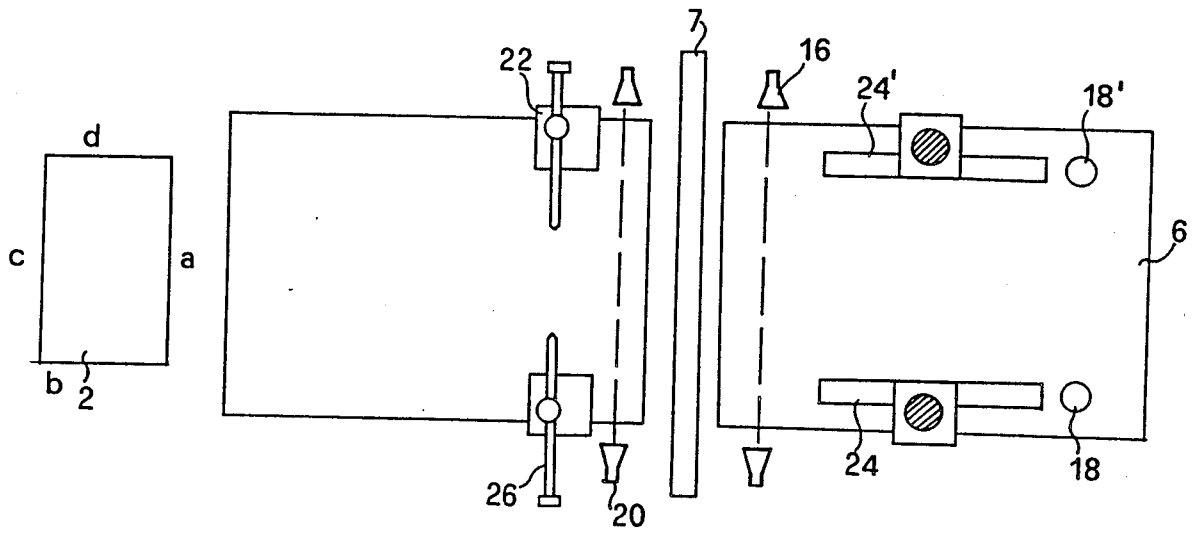
FIG. 4 illustrates an alternate embodiment of the invention which includes a pair of longitudinal sealing bars.

An embodiment of the invention which improves the precision with which the plastic wrapping is formed is illustrated in FIG. 4, in which the elements represented in FIGS. 1, 2 and 3 are indicated by the same reference numbers.

In this embodiment, instead of the single longitudinal sealing bar 8 shown in FIGS. 1, 2 and 3, a pair of longitudinal sealing bars 24, 24' and respective sealing counterbars are used (not illustrated).

An electromechanical device 22 is placed above conveyor 4 feeding the automatic bundling machine and is made up of two proximity sensors or feelers 26, which, resting on the longitudinal sides (b, d) of baggage 2 determine the transversal dimensions (a, c) of the same. The synchronous movement of the two "feelers" is controlled by a powered worm gear and stoppage at contact with the baggage on conveyor 4 is ensured by two end switches. Said movement, by using appropriate electric pulses, determines the closure of the two lateral sealing bars 24 and 24' and respective sealing counterbars until they are positioned at a reciprocal distance equal to that of the transversal dimensions (a, c).

At the end of each wrapping cycle the device 22 returns to its starting position in order to read the dimensions of the next piece of baggage to be wrapped. The object of the automatic centering system is to carry out the side seals automatically as near as possible to the longitudinal sides (d, b), as the transversal dimensions are always different.

Therefore, on completion of the sealing phase carried out by bar 7, the longitudinal sealing bars 24, 24' and the respective sealing counterbars move horizontally across working surface 6 in a direction perpendicular to the motion of baggage 2, on receiving pulses from the automatic centering system 22, according to the position of the sensors which read the transversal dimensions (a, c).

Through sensors 18, 18' the sealing bars 24, 24' are then activated and brought into contact with their respective counterbars to carry out the sealing with overlap of the two longitudinal sides (b, d) of baggage 2.

At this point baggage 2 is perfectly sealed on three sides (c, b, d), as the front end (a) is automatically closed by the continuity of said sheet 12 of plastic film. An adequate excess of said sheet 12 is also furnished in the second phase above in order to permit the perfect execution of said longitudinal sealing with overlap, with the simultaneous cutting of the excess part of said sheet 12 and the expulsion of the same into suitable containers. The object 2 contained in said wrapping of plastic film closed on four sides (a, b, c, d), is then transported by means of the same conveyor belt 6 to the hot air tunneltype oven 14.

The system using sealing bars at right angles to each other, actuated by optical sensors that transmit electrical impulses to the relative servo-drives, makes it possible to wrap, in uninterruped succession, objects of constantly differing dimensions with the right quantity of heat-shrinkable plastic film, thereby achieving made-to-measure wrapping that adheres perfectly to the wrapped object's dimensions, without any excess plastic film, neither transversally nor longitudinally, which would result in an excessive accumulation of plastic film along the sealed edges of the protective wrapper.

INDUSTRIAL APPLICABILITY

A particularly congenial utilization of this invention is that of the protective wrapping of pieces of baggage of various dimensions (luggage, handbags, packsacks, bags, etc.), especially when it is necessary for them to be handled by others, as is the case at airports and similar locations, effected directly by the interested parties. For this purpose, the machine may be equipped with an optical coin sensor or photoelectric cell for automatic starting of the wrapping cycle described above, of suitable reference templates on starting platform 1 for the correct positioning of every piece of baggage, of appropriate supports for any handles on the baggage to favour their protrusion from said plastic wrapper on the fourth contact-sealed side during the heat-shrinkage phase in oven 14.

In this way the aim would be attained of preserving the baggage items consigned to carriers by passengers against all the damage that inevitably occurs during loading, transport, unloading and reconsignment phases.

This invention is not limited to the embodiments as described, but can be made to take any alternative form.

I claim:

1. A method for the automatic wrapping of single pieces of baggage of different dimensions in a film of a heat-shrinkable plastic material to be sealed on the rear side by a transversal sealing and on both lateral sides by longitudinal side sealings, comprising:

charging a piece of baggage on a first conveyor and operating said conveyor;

detecting the position of a leading side of said piece for stopping said first conveyor with the piece in said position;

detecting the transverse dimension of said piece by a pair of contact feelers actuated by an actuating device and at the same time positioning side sealing bars at a second conveyor in an operative position controlled on the transverse dimension detected by said feelers;

re-operating said first and second conveyors and detecting when the rear side of said piece overpasses a position fixed on said second conveyor and stopping said second conveyor;

effecting a sealing of said film on the rear side of said piece;

re-operating said second conveyor and detecting when the leading side of said piece reaches a fixed position on said second conveyor and stopping said second conveyor;

effecting the side sealings on the lateral sides of said piece with the side sealing bars in said operative position;

re-operating said second conveyor for carrying said piece to a heat-shrinking oven; and resetting said feelers and said longitudinal bars to their starting positions.

2. A machine for the automatic wrapping of single pieces of baggage of different dimensions in a film of a heat-shrinkable plastic material, comprising:

a first conveyor and a second conveyor for carrying a piece of baggage in a longitudinal direction;

first optical sensor means for stopping said first conveyor when said piece of baggage is detected by said first optical means;

a pair of feelers and a pair of actuating devices therefor, for revealing the transverse dimension of the piece of baggage when said first conveyor is stopped, by moving said feelers from a starting position to a contact position, in contact with both sides of said piece of baggage, such that the movement distance of said feelers is defined by the transverse dimension of said piece of baggage;

means for re-operating said first conveyor when said contact position is reached for passing said piece of baggage to the second conveyor;

second optical sensor means at said second conveyor for stopping said second conveyor when the overpassing of said piece of baggage is detected by said second optical sensor means, to ensure that the longitudinal dimension of said piece of baggage is entirely on said second conveyor;

a pair of transversal sealing bars placed between said first and second conveyors for transversal sealing of said film of plastic drawn by said piece of baggage from a pair of transversal reels along its travel from the first to the second conveyor and after its stopping an overpassing said second optical means;

means for re-operating said second conveyor when said transversal sealing is completed;

third optical sensor means for stopping said second conveyor when said piece of baggage is detected by said third optical sensor means;

two pairs of side sealing bars for a simultaneous side sealing of said plastic film on the longitudinal sides of said piece of baggage on said second conveyor after stopping thereof by said third optical sensor means; and electromechanical means for actuating said pairs of side sealing bars from a starting position to an operating position, said electromechanical means being controlled by said actuating devices and said feelers for positioning said side sealing bars at a distance one from the other depending on the transversal dimension of said piece of baggage.

3. The machine according to claim 2, further comprising a tunnel-type oven for heat-shrinking said plastic film;

a third conveyor disposed in said oven onto which the piece of baggage is transferred from said second conveyor, said third conveyor having an output side extending outside of said oven; and reception means for receiving said baggage enclosed in said shrunk plastic film after said baggage has passed through said oven, said reception means being disposed at the output side of said third conveyor.

4. The machine according to claim 3, in which said third conveyor is either straight or curved.

5. The machine according to claim 3 in which said tunneltype oven is of the hot-air type.

6. The machine according to claim 3, in which said reception means for baggage wrapped in said shrunk plastic film comprises an idler-roller rack.

7. The machine according to claim 2, in which said first and second are conveyor belts.

8. The machine according to claim 2, in which said first optical sensor means comprise two optical readers situated one on each longitudinal side of said first conveyor, above the latter and on the first conveyor side of said pair of transversal sealing bars.

9. The machine according to claim 2, in which said second optical sensor means comprise two optical readers situated one on each longitudinal side of said second conveyor, the above latter and on the second conveyor side of said pair of transversal sealing bars.

10. The machine according to claim 2, in which said starting station comprises a conveyor belt suitable for the positioning of individual pieces of baggage to be wrapped and equipped with a manual or an automatic control to start said first conveyor for every single piece.

* * * * *